US010184206B2

(12) United States Patent
Kim et al.

(10) Patent No.: US 10,184,206 B2
(45) Date of Patent: Jan. 22, 2019

(54) CLOTHES TREATING APPARATUS AND CONTROL METHOD THEREOF

(71) Applicant: LG ELECTRONICS INC., Seoul (KR)

(72) Inventors: Youngsuk Kim, Seoul (KR); Injae Han, Seoul (KR); Sangwook Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 556 days.

(21) Appl. No.: 14/884,058

(22) Filed: Oct. 15, 2015

(65) Prior Publication Data

US 2016/0115638 A1 Apr. 28, 2016

(30) Foreign Application Priority Data

Oct. 28, 2014 (KR) ..... 10-2014-0147300

(51) Int. Cl.

| | |
|---|---|
| ***F26B 3/00*** | (2006.01) |
| ***D06F 58/20*** | (2006.01) |
| ***D06F 58/02*** | (2006.01) |
| ***D06F 58/28*** | (2006.01) |

(52) U.S. Cl.

CPC ..... *D06F 58/206* (2013.01); *D06F 58/02* (2013.01); *D06F 58/28* (2013.01); *D06F 58/20* (2013.01); *D06F 2058/2864* (2013.01)

(58) Field of Classification Search

CPC ..... D06F 58/206; D06F 58/28

USPC ... 34/321, 86, 499, 454, 108, 115, 119, 122, 34/124

See application file for complete search history.

(56) References Cited

U.S. PATENT DOCUMENTS

2009/0241366 A1* 10/2009 Park ..... D06F 25/00 34/467
2010/0083524 A1 4/2010 Muller et al.
2012/0272689 A1* 11/2012 Elger ..... D06F 39/04 68/20

FOREIGN PATENT DOCUMENTS

| | | |
|---|---|---|
| CN | 1766214 | 5/2006 |
| CN | 102216510 | 10/2011 |
| CN | 102906327 | 1/2013 |
| CN | 103827385 | 5/2014 |
| DE | 42 16 106 A1 | 11/1993 |
| DE | 10 2007 016077 A1 | 10/2008 |

(Continued)

OTHER PUBLICATIONS

Chinese Office Action dated Apr. 1, 2017 issued in Application No. 201510697480.6 (English translation attached).

(Continued)

*Primary Examiner* — John McCormack
(74) *Attorney, Agent, or Firm* — KED & Associates, LLP

(57) ABSTRACT

Provided is a clothes treating apparatus which may include a cabinet defining an outer appearance of the apparatus and having an introduction opening, a clothes receiving device provided in the cabinet and receiving therein clothes through the introduction opening, a circulation passage through which internal air of the clothes receiving device circulates, a heat-exchanging passage connected to the circulation passage to guide external air outside the circulation passage into the circulation passage for heat exchange with the internal air of the circulation passage, and a fan provided at the heat-exchanging passage to generate airflow in the heat-exchanging passage.

18 Claims, 8 Drawing Sheets

(56) References Cited

FOREIGN PATENT DOCUMENTS

| | | | |
|---|---|---|---|
| EP | 2 107 157 | A1 | 10/2009 |
| EP | 2 573 253 | A1 | 3/2013 |
| WO | WO 2011/151204 | A2 | 12/2011 |
| WO | WO 2013/182400 | A1 | 12/2013 |

OTHER PUBLICATIONS

European Search Report dated Dec. 21, 2015 issued in Application No. 15190432.3.

* cited by examiner

CLOTHES TREATING APPARATUS AND CONTROL METHOD THEREOF

CROSS-REFERENCE TO RELATED APPLICATION(S)

Pursuant to 35 U.S.C. § 119(a), this application claims the benefit of earlier filing date and right of priority to Korean Application No. 10-2014-0147300, filed on Oct. 28, 2014, the contents of which is incorporated by reference herein in its entirety.

BACKGROUND

1. Field

This specification relates to a clothes treating apparatus and a method of controlling the same.

2. Background

A clothes treating apparatus (a laundry machine or a laundry treating apparatus) is home appliances which can wash and/or dry clothes, and includes a washing machine, a drying machine and a drying washing machine.

Clothes treating apparatuses which can dry clothes are configured to supply air of high temperature (hot air) to clothes and may be classified into an exhaust type and a circulation type on the basis of an air flowing method.

The circulation type clothes treating apparatus is configured in a manner of circulating air supplied to a clothes receiving device, removing (dehumidifying) moisture from the circulated air, heating the dehumidified air, and supplying the heated air back into the clothes receiving device. The exhaust type clothes treating apparatus is configured in a manner of exhausting air supplied to a clothes receiving device to outside without circulation.

Meanwhile, a hot air supply device provided in the related art clothes treating apparatus includes a heat-exchanging device that heats air supplied to the clothes receiving device, and a blower that makes an air flow for supplying the heated air into the clothes receiving device.

However, the related art clothes treating apparatus has a problem in that a compressor, which is connected to the heat-exchanging device to circulate a refrigerant and compress the refrigerant into a state of high pressure, may generate a large amount of heat.

Also, since temperature of internal air of a tub may be lower than room temperature due to wash water supplied from an outside, it takes a large amount of time and energy to heat the air in the heat-exchanging device in order to generate air of high temperature (hot air) required for drying clothes. The clothes treating apparatus of the present disclosure addresses these and other disadvantages.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Description will now be given in detail of the preferred embodiments according to the present disclosure, with reference to the accompanying drawings. Meanwhile, a configuration or control method to be described hereinafter is merely illustrative and will not limit the rights of the present disclosure. For the sake of brief description with reference to the drawings, the same or equivalent components may be provided with the same or similar reference numbers, and description thereof will not be repeated.

Figure 1:
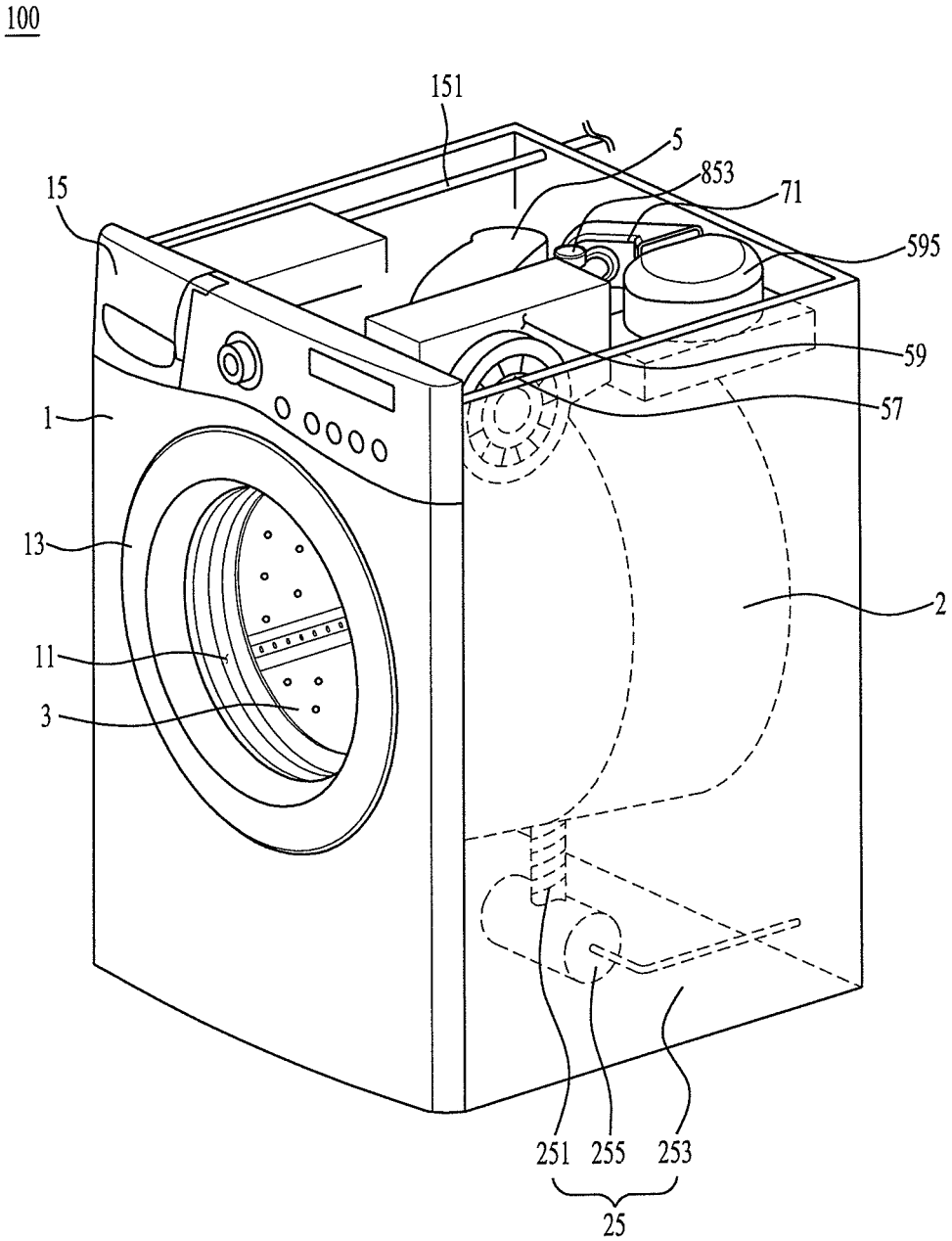
FIG. 1 is a perspective view of a clothes treating apparatus in accordance with one exemplary embodiment of the present disclosure.
Figure 2:
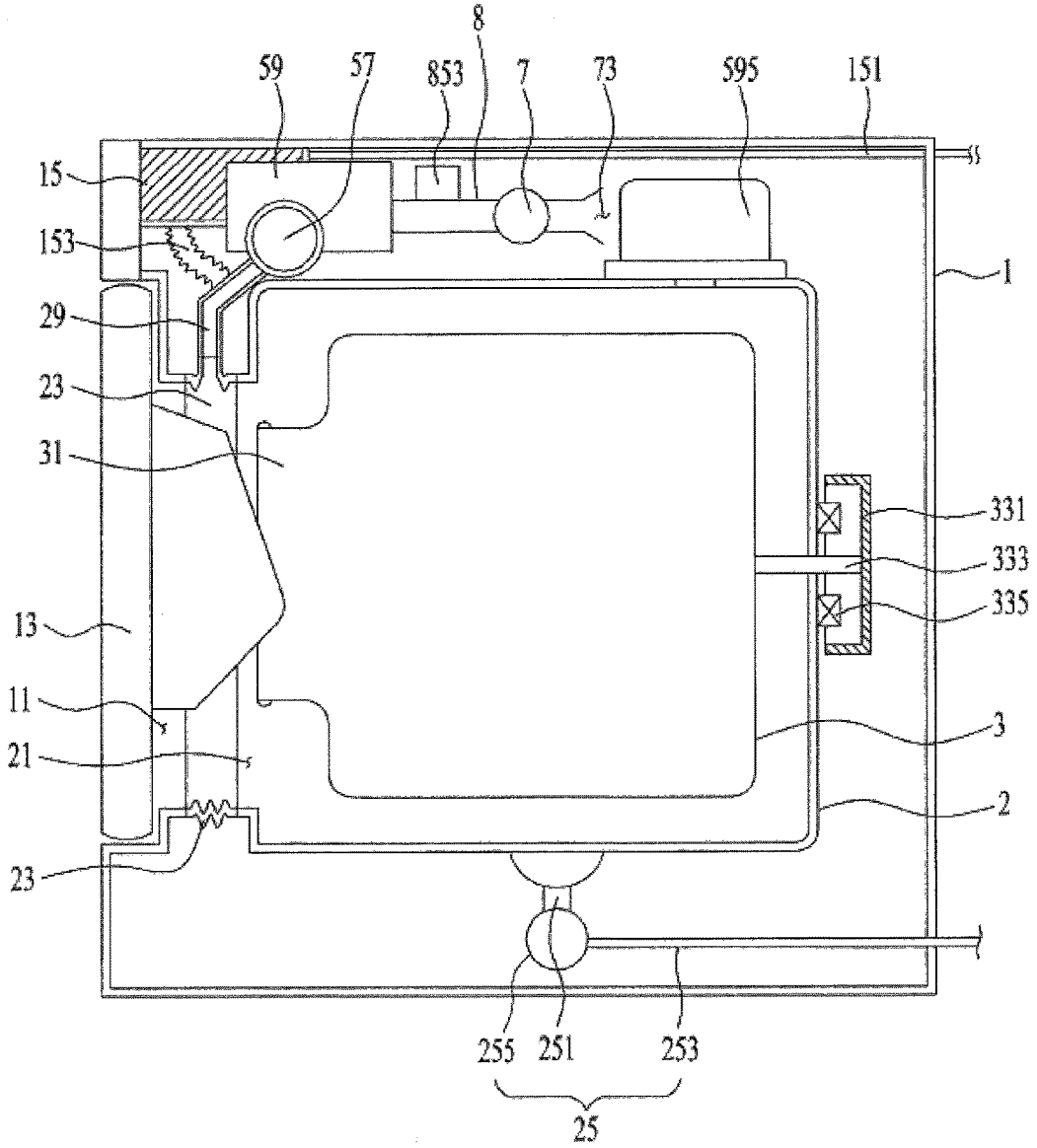
FIG. 2 is a sectional view of the clothes treating apparatus in accordance with the one exemplary embodiment of the present disclosure.

FIG. 1 is a perspective view of a clothes treating apparatus 100 in accordance with one exemplary embodiment of the present disclosure, and FIG. 2 is a sectional view of the clothes treating apparatus 100 in accordance with the one exemplary embodiment of the present disclosure.

As illustrated in FIGS. 1 and 2, a clothes treating apparatus 100 according to the present disclosure may include a cabinet 1 that defines an outer appearance of the apparatus, a clothes receiving device 2 and 3 provided in the cabinet 1 to receive (accommodate or store) clothes therein, and a hot air supply device 5 that supplies hot air into the clothes receiving device 2 and 3. The cabinet 1 includes an introduction opening 11 through which clothes is introduced therein, and a door 13 rotatably coupled to the cabinet 1 to open and close the introduction opening 11.

When the clothes treating apparatus 100 according to the present disclosure is merely configured as a drying machine which has a clothes drying function, the clothes receiving device 2 and 3 may include only a drum 3 rotatably disposed in the cabinet 1.

Also, when the clothes treating apparatus 100 is configured as an apparatus which has both functions of washing and drying clothes, the clothes treating apparatus 2 and 3 may include a tub 2 disposed in the cabinet 1 to store wash water therein, and a drum 3 rotatably disposed in the cabinet 2 to store the clothes therein.

Hereinafter, simply for convenience, description will be given of an example in which the clothes receiving device includes the tub 2 and the drum 3. It should be appreciated that the present disclosure is applicable to other types of clothes treating apparatus.

The tub 2 may have a cylindrical shape with a hollow inner space. The tub 2 may include a tub introduction opening 21 formed at a front surface thereof, and the tub introduction opening 21 may communicate with the introduction opening 11 such that the clothes or laundry can be introduced and taken away therethrough.

A gasket 23 may be provided between the tub introduction opening 21 and the introduction opening 11. The gasket 23 may be made of a vibration-insulating material, such as rubber. Therefore, the gasket 23 may prevent the wash water stored in the tub 2 from being leaked out of the tub 2, and also vibration of the tub 2, which is generated due to rotation of the drum 3, from being transferred to the cabinet 1.

To fix the tub 2 in the cabinet 1, fixing members (not illustrated) by which an upper or lower surface of the tub 2 is fixedly connected to the cabinet 1 may be provided. The tub 2 may be arranged in parallel to the ground, or to be inclined from the ground by a predetermined angle.

An air exhaust portion 27 (see FIG. 3) through which internal air of the tub 2 is exhausted is provided on an upper portion of a circumferential surface of the tub 2, and a water drain portion 25 through which the wash water stored in the tub 2 is discharged is provided below the tub 2.

Figure 3:
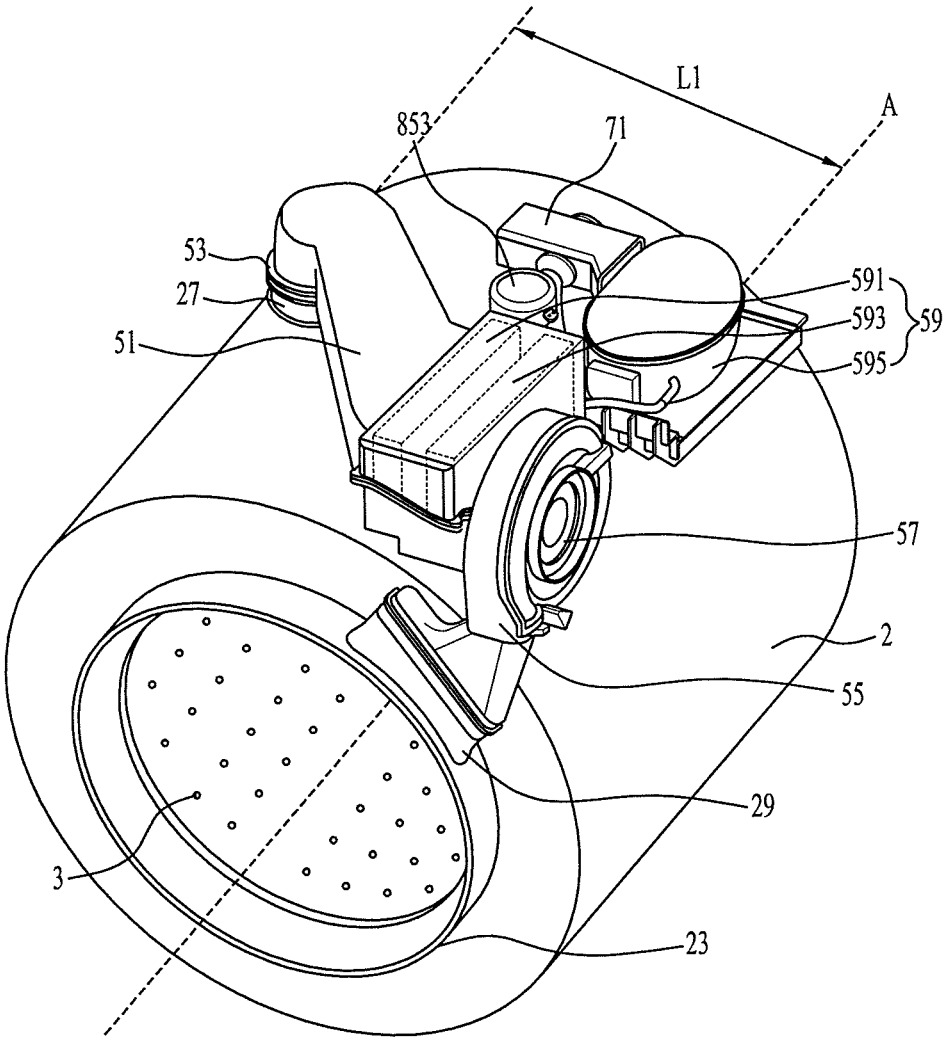
FIG. 3 is a perspective view of the clothes treating apparatus, except for a cabinet, in accordance with the one exemplary embodiment of the present disclosure.

The air exhaust portion 27 is provided on the upper surface of the tub 2, preferably, spaced apart from a straight line A, which passes through a center of the tub 2, by a predetermined distance L1 in a circumferential direction of the tub 2 (see FIG. 3). This is for facilitating the internal air of the tub 2 to be discharged out of the tub 2 through the air exhaust portion 27 during the rotation of the drum 3.

The water drain portion 25 may include a drain pump 255 through which discharged (used) wash water is drained out of the cabinet 1, a first drain pipe 251 through which the drain pump 255 is connected to the tub 2, and a second drain pipe 253 guiding the wash water introduced into the drain pump 255 to the outside of the cabinet 1.

The tub 2 stores wash water that is supplied through a water supply pipe 151 connected to a water supply source. Alternatively, when a detergent supply device 15 for supplying detergent is provided at the cabinet 1, the water supply pipe 151 may be configured to supply wash water to the detergent supply device 15 therethrough. Here, the wash water supplied to the detergent supply device 15 may then be supplied into the tub 2 through a detergent supply pipe 153.

The drum 3 may have a cylindrical shape with a hollow inner space, and be rotatably disposed in the tub 2. A driving unit for rotating the drum 3 may be provided in the clothes treating apparatus 100. The driving unit may include a stator 335 fixed to a rear surface of the tub 2 to generate a magnetic field, a rotor 331 rotated by the magnetic field, and a rotation shaft 333 penetrating through the rear surface of the tub 2 to connect a rear surface of the drum 3 to the rotor 331.

In the meantime, the drum 3 may include a drum introduction opening 31 formed at a front surface thereof, so as to communicate with the introduction opening 11 and the tub introduction opening 21. A user may thus put clothes or laundry into the drum 3 and take the clothes stored in the drum 3 out of the cabinet 1 through the introduction opening 11.

As illustrated in FIG. 3, a hot air supply device 5 may include a circulation passage 51, 53 and 55 to guide air discharged from the tub 2 toward a front side of the tub 2, a heat-exchanging device 59 provided in the circulation passage 51, 53 and 55, and a blower 57 to circulate internal air of the circulation passage.

The circulation passage may include a first connection duct 53 connected to the upper portion of the circumferential surface of the tub 2, a duct 51 connected to the first connection duct 53 and provided with the heat-exchanging device 59 therein, and a second connection duct 55 to guide air discharged from the duct 51 toward the front side of the tub 2.

The first connection duct 53 is a passage connected to the air exhaust portion 27 located at the upper portion of the circumferential surface of the tub 2, and preferably formed as a vibration-insulating member (rubber, etc.). This is to prevent the vibration transferred to the tub 2 during the rotation of the drum 3 from being carried to the heat-exchanging device 59 located in the duct 51 through the first connection duct 53. To more efficiently prevent the vibration generated in the tub 2 from being transferred to the duct 51 and the heat-exchanging device 59, the first connection duct 53 may be formed in a shape of a bellows.

The second connection duct 55 may be connected to any area of the tub 2 if the area is allowed to guide the air discharged through the duct 51 toward the front side of the tub 2. In one embodiment of the present disclosure, preferably, the tub 2 is provided with the gasket 23 protruding from the tub introduction opening 21 toward the front of the tub 2 and the second connection duct 55 allows air to be supplied into the tub 2 through the gasket 23. In this instance, the gasket 23 is provided with a supply portion 29 communicating with the second connection duct 55.

The blower 57 may be provided at the second connection duct 55. The blower 57 may include an impeller (not illustrated) located in the second connection duct 55, and an impeller motor (not illustrated) rotating the impeller.

Hereinafter, the heat-exchanging device 59 will be described. The heat-exchanging device 59 may be configured as a heat pump. In this instance, a first heat exchanger 591 (i.e., an evaporator) and a second heat exchanger 593 (i.e., a condenser) provided in the heat-exchanging device 59 are fixed in the duct 51. A compressor 595 compresses a refrigerant discharged from the evaporator 591 and supplies the compressed refrigerant to the condenser 593. The refrigerant supplied to the condenser 593 should be supplied back to the evaporator 591 through an expansion apparatus.

In the evaporator 591, the refrigerant is evaporated by absorbing heat from air introduced into the duct 51. Therefore, the evaporator 591 serves to remove (dehumidify) moisture contained in air by cooling the air.

The condenser 593 condenses the refrigerant. Since heat generated during the process of condensing the refrigerant is transferred to air passing through the evaporator 591, the condenser 593 serves to heat the air passed through the evaporator 591.

The heat-exchanging device 59 and the blower 57 operate to supply hot air in order to dry the clothes washed using detergent and wash water in the tub 2 and the drum 3. When the blower 57 operates, air in the tub 2 circulates back to the tub 2 along the circulation passage 51, 53 and 55.

Since the air circulating along the circulation passage 51, 53 and 55 becomes humid and is at room temperature, the air is not suitable for drying clothes. Therefore, the air is dehumidified through the evaporator 591 provided in the circulation passage 51, 53 and 55 and heated through the condenser 593, so as to become dry and hot. The dry and hot air is thus supplied to the clothes.

The compressor 595 compresses a vaporized refrigerant discharged from the evaporator 591 into gas of high temperature and high pressure. Such gaseous refrigerant is supplied into the condenser 593. Accordingly, the compressor 595 generates much heat due to an excessive load thereof during the process of compressing the refrigerant.

Figure 4:
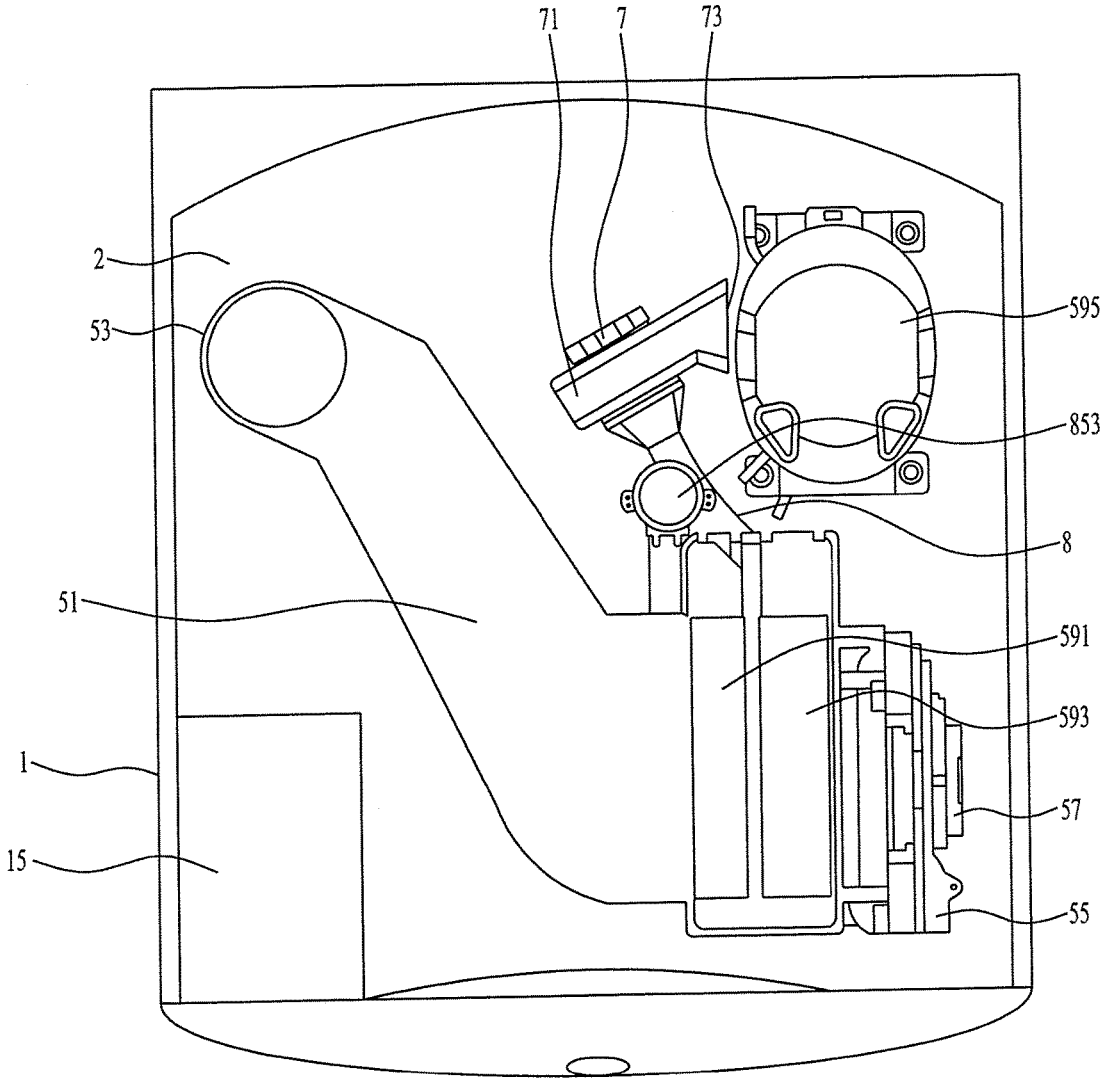
FIG. 4 is an upper sectional view of the clothes treating apparatus in accordance with the one exemplary embodiment of the present disclosure.

To solve this problem, as illustrated in FIG. 4, the clothes treating apparatus 100 according to the present disclosure may include a fan 7 to supply external air to the compressor 595 to cool the heated compressor 595.

A cooling opening 73 may be provided toward the compressor 595 to prevent spread of the air supplied to the compressor 595. A fan duct 71 may be provided to accommodate therein the fan 7. This may allow for effectively cooling the compressor 595.

Air circulating along the circulation passage 51, 53 and 55 is internal air of the tub 2, and the internal air of the tub 2 is typically at room temperature or temperature lower than the room temperature due to wash water supplied from the water supply source. Therefore, to heat the air circulating along the circulation passage 51, 53 and 55 by use of the heat-exchanging device 59, a predetermined time should be taken, and a predetermined amount of heat energy should be supplied.

However, external air of the circulation passage, namely, air filled in a space between the cabinet 1 and the tub 2 has temperature higher than the room temperature due to heat energy generated from the driving unit rotating the drum 3 and the like.

The clothes treating apparatus 100 according to the present disclosure is provided with an element which is configured to raise temperature of internal air of the circulation passage 51, 53 and 55 through heat exchange between the external air and the internal air of the circulation passage 51, 53 and 55 using the fan 7. This may result in a reduction of the amount of time required to heat the internal air of the circulation passage 51, 53 and 55 and energy savings.

When the fan 7 makes the external air of the circulation passage 51, 53 and 55 circulate into the passage, it may result in reducing humidity of the internal air of the circulation passage 51, 53 and 55. Therefore, the dried internal air of the circulation passage 51, 53 and 55 may result in saving in time and energy required for heating the air by the condenser. The heat-exchange through the circulation between the internal air and the external air of the circulation passage 51, 53 and 55 may be executed even during a washing step as well as the drying step.

The clothes treating apparatus 100 according to the present disclosure may include a heat-exchanging passage 8 through which the fan 7 and the circulation passage 51, 53 and 55 are connected to each other. However, the heat-exchanging passage 8 is preferably connected to the duct 51 for efficient heat exchange. When the fan 7 operates, external air is introduced into the duct 51 through the heat-exchanging passage 8, thereby increasing temperature of internal air of the duct 51 and lowering humidity of the internal air of the duct 51.

Figure 5A:
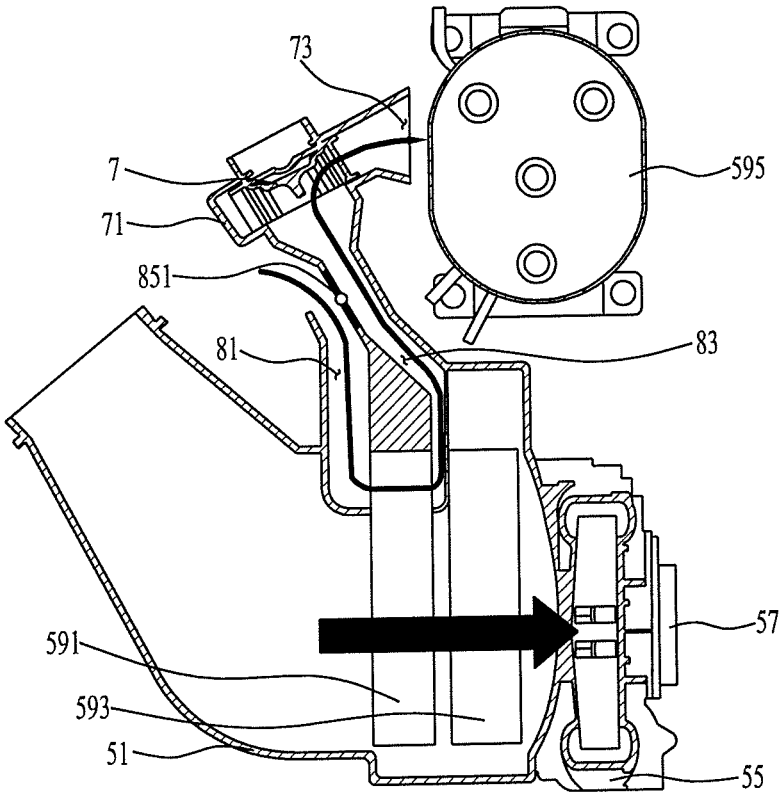
FIG. 5A is a status view of a heat-exchanging step in the upper sectional view of the clothes treating apparatus in accordance with the one exemplary embodiment of the present disclosure.
Figure 5B:
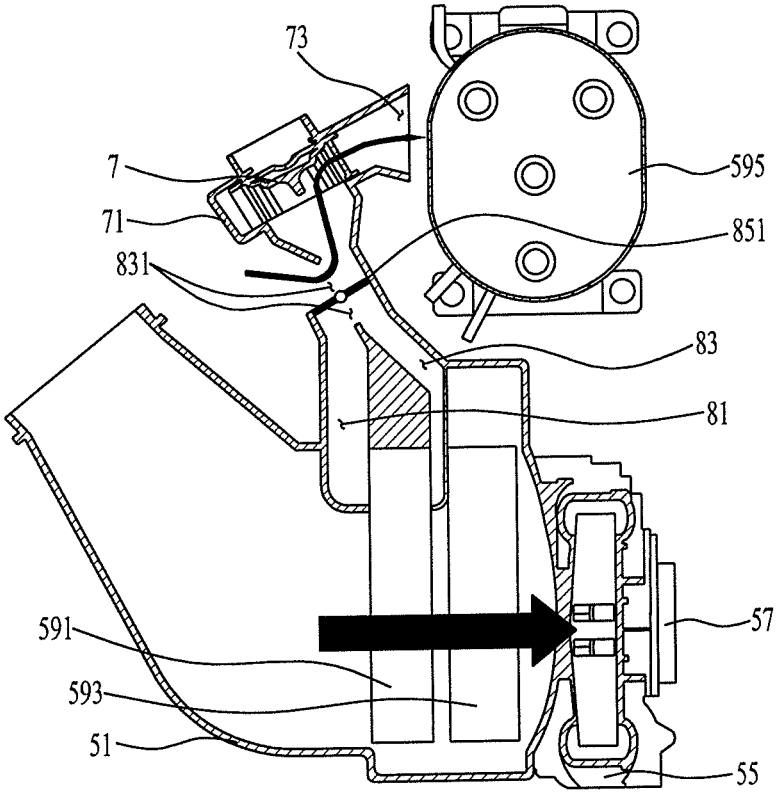
FIG. 5B is a status view of a cooling step in the upper sectional view of the clothes treating apparatus in accordance with the one exemplary embodiment of the present disclosure.

As illustrated FIG. 5A and FIG. 5B, the heat-exchanging passage 8 may include a first heat-exchanging duct 81 through which external air is introduced into the duct 51, and a second heat-exchanging duct 83 through which internal air of the duct 51 is discharged. The heat-exchanging passage 8 may have one end open to allow for the introduction of external air of the tub 2 into the duct 51, and another end connected to the duct 51. The second heat-exchanging duct 83 may have one end connected to the duct 51 and another end connected to the fan 7 to discharge the internal air of the duct 51.

The fan 7 may be driven to generate negative pressure in the second heat-exchanging duct 83. The internal air of the duct 51 may flow toward the second heat-exchanging duct 83 and external air in the first heat-exchanging duct 81 may flow toward the duct 51. Accordingly, the external air outside the duct 51 may be introduced through the first heat-exchanging duct 81. That is, the external air of the duct 51 flows sequentially along the first heat-exchanging duct 81, the duct 51, the second heat-exchanging duct 83 and the fan 7.

Hereinafter, an air flow at the duct 51 will be described in detail.

The first heat-exchanging duct 81 and the second heat-exchanging duct 83 forming the heat-exchanging passage 8 may be connected to the heat-exchanging device 591, 593 provided in the duct 51.

The heat-exchanging device may include the first heat-exchanger 591 (i.e., the evaporator) for dehumidifying internal air of the circulation passage, and the second heat-exchanger 593 (i.e., the condenser) for heating the internal air of the circulation passage. The first heat-exchanging duct and the second heat-exchanging duct are preferably connected to the evaporator 591.

Therefore, temperature of air in the evaporator 591 or around the evaporator 591 can be increased, and thus, a quantity of moisture dehumidified in the evaporator 591 can be decreased. This may result in an increase in efficiencies of the evaporator and the condenser and a decrease in load of the compressor.

Also, since humidity of air passed through the evaporator 591 is lowered, temperature of air can more quickly be raised in the condenser 591. Also, since humid internal air of the circulation passage, passing through the evaporator, can be dried, it may allow such dry air to be heated faster in the condenser through the evaporator.

As illustrated in FIGS. 4 and 5, the clothes treating apparatus 100 according to the present disclosure may include a valve unit (also referred to herein as an opening/closing, unit) provided at the heat-exchanging passage 8 to open and close the heat-exchanging passage 8.

The valve unit may include an opening/closing member 851 to open and close the first heat-exchanging duct 81 and the second heat-exchanging duct 83, and a controller 853 to manipulate the opening/closing member 851. The opening/closing member 851 may be a valve and the controller 853 may be a valve controller. The valve 851 may be a plate, disc, or the like, configured to rotate about an axis to open or close the heat-exchanging passage. It should be appreciated that the valve 851 may be one of a variety of types of valves based on the desired application and function of the valve. Moreover, the valve controller 853 may include an actuator for the valve.

The valve controller 853 may be electrically driven by a controller (not illustrated) to open the valve 851 at an opening operation and close the valve 851 at a closing operation. The valve 851 may open and close the first heat-exchanging duct 81 and the second heat-exchanging duct 83 at the same time or in an individual manner.

The clothes treating apparatus 100 according to the present disclosure may include an inner air hole 831 penetrating through the first heat-exchanging duct 81 and the second heat-exchanging duct 83 (see FIG. 5B). The inner air hole 831 is preferably located between one end of the first heat-exchanging duct 81 open to outside, and one end of the second heat-exchanging duct 83 connected to the fan 7.

Referring to FIG. 5A, when the first heat-exchanging duct 81 and the second heat-exchanging duct 83 are open by the valve 851, the inner air hole 831 may be closed by the valve 851. Therefore, air flow between the first heat-exchanging duct 81 and the second heat-exchanging duct 83 through the inner air hole 831 is not generated. External air may thus circulate sequentially along the first heat-exchanging duct 81, the evaporator 591 within the duct 51, the second heat-exchanging duct 83 and the fan 7.

Referring to FIG. 5B, when the first heat-exchanging duct 81 and the second heat-exchanging duct 83 are closed by the valve 851, the first heat-exchanging duct 81 and the second heat-exchanging duct 83 communicate with each other through the inner air hole 831. In this case, internal air of the first heat-exchanging duct 81 and the second heat-exchanging duct 83 circulates and flows along with internal air of the duct 51 and is not moved out of the duct 51. Moreover, airflow may be generated to flow directly to the compressor to cool the compressor.

The valve 851 may be provided at one end of the inner air hole 831 to simultaneously open/close the first heat-exchanging duct 81 and the second heat-exchanging duct 83, and complementarily open/close the inner air hole 831.

Hereinafter, a method of controlling the clothes treating apparatus 100 according to the present disclosure will be described.

Figure 6:
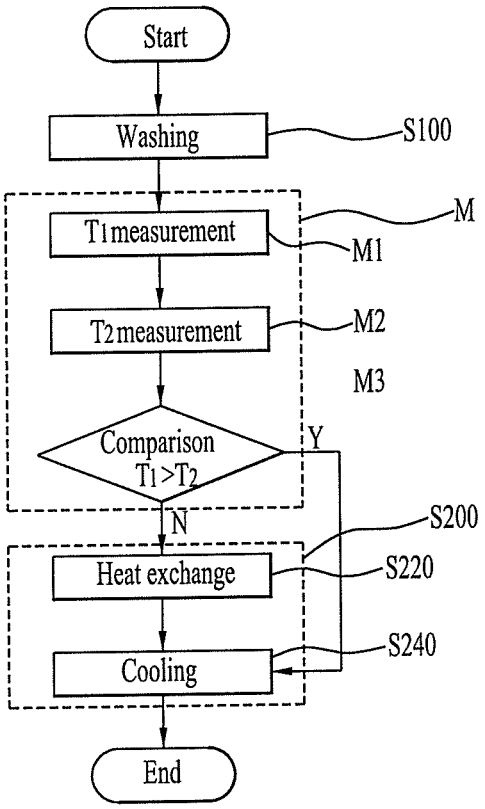
FIG. 6 is a block diagram illustrating a method for controlling a clothes treating apparatus in accordance with one exemplary embodiment of the present disclosure.

As illustrated in FIG. 6, a method of controlling the clothes treating apparatus 100 may include a washing step (S100) of washing clothes stored (received) in the clothes receiving device 2, 3, and a drying step (S200) of drying the washed clothes. However, a method of controlling a clothes treating apparatus including the drying step (S200) without the washing step (S100) may be applied to a clothes treating apparatus such as a drying machine.

Although not illustrated, the washing step (S100) may include a heat-exchanging step (S220) of circulating internal air and external air of the duct 51 for heat exchange therebetween by operating the fan 7. This may provide an effect of raising temperature and lowering humidity of the internal air of the duct 51.

Also, the drying step (S200) may also include the heat-exchanging step (S220) of circulating the internal air and the external air of the duct 51 for heat exchange therebetween by operating the fan 7. Therefore, the internal air of the duct 51 can be increased in temperature and decreased in humidity. Also, the internal air of the duct 51 can primarily be heated before being heated by the condenser, which may result in an increase in efficiencies of the condenser and the evaporator and a reduction of a load of the compressor. The heat-exchanging step (S220) may be configured to perform heat exchange between the internal air and the external air of the duct 51 through the heat-exchanging passage 8.

Also, the heat-exchanging passage, as aforementioned, may be provided with the first heat-exchanging duct and the second heat-exchanging duct, so as to form separate passages for air introduced from outside of the duct and air discharged from inside of the duct.

Therefore, temperature of the internal air of the duct may be increased through the heat exchange with the external air of the duct having relatively higher temperature, and humidity of the internal air of the duct may be reduced through the circulation along with the external air having relatively lower humidity.

Meanwhile, when the compressor 595 is heated by operating a heat pump in order to heat the internal air of the duct 51, a cooling step (S240) of cooling the heated compressor 595 by operating the fan 7 may be included in the control method. That is, at the cooling step, the fan 7 may be driven to supply flowing air to the heated compressor, thereby cooling an outside of the compressor.

Hereinafter, the heat-exchanging step and the cooling step will be described in detail.

Figure 7:
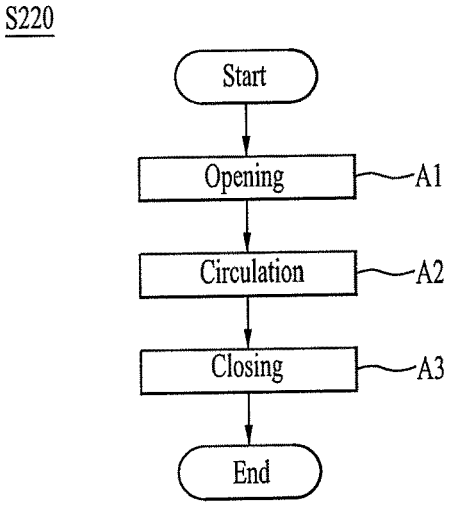
FIG. 7 is a block diagram of a heat-exchanging step of FIG. 6.

As illustrated in FIG. 7, the heat-exchanging step (S220) may include an opening step (A1) of opening the first heat-exchanging duct 81 and the second heat-exchanging duct 83 by operating the opening/closing unit, a circulating step (A2) of introducing external air of the duct 51 through the first heat-exchanging duct 81 and discharging internal air of the duct 51 through the second heat-exchanging duct 83 by operating the fan 7, and a closing step (A3) of closing the first heat-exchanging duct 81 and the second heat-exchanging duct 83 by operating the opening/closing unit after the circulating step (A2). Therefore, by controlling the opening step and the closing step, an amount of circulating external air and internal air of the duct or a circulation time thereof can be adjusted, if necessary.

Figure 8:
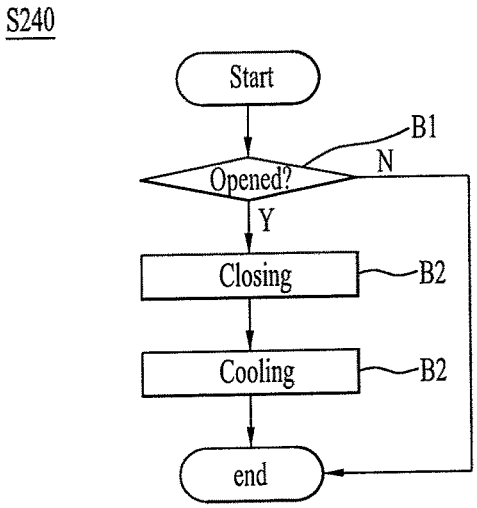
FIG. 8 is a block diagram of a cooling step of FIG. 6.

As illustrated in FIG. 8, the cooling step (S240) may include an opening/closing checking step (B1) of checking whether or not the first heat-exchanging duct 81 and the second heat-exchanging duct 83 have been opened and going to the next step when closed, a step (B2) of closing the first heat-exchanging duct 81 and the second heat-exchanging duct 83 by operating the opening/closing unit when open, and going to the next step, and a supplying step (B3) of supplying air to the compressor 595 by operating the fan 7, to cool the compressor 595.

Meanwhile, the control method for the clothes treating apparatus 100 according to the present disclosure may further include a temperature comparing step (M) before the heat-exchanging step. Therefore, the temperature comparing step may be carried out before the heat-exchanging step which is performed during the washing step, and before the heat-exchanging step which is performed during the drying step, respectively.

As illustrated in FIG. 6, the temperature comparing step (M) may include a step (M1) of measuring an internal temperature T1 of the duct 51, a step (M2) of measuring an external temperature T2 of the duct 51, a step (M3) of comparing the internal temperature T1 with the external temperature T2, and a step of performing the cooling step (S240) when the internal temperature T1 is higher than the external temperature T2 and performing the heat-exchanging step (S220) when the internal temperature T1 is lower than the external temperature T2.

To perform the temperature comparing step (M), a temperature sensor of measuring the internal and external temperatures of the duct 51 may be provided. And, a controller may be provided to determine whether to perform either the cooling step (S240) or the heat-exchanging step (S220) by storing and comparing signals transferred from the temperature sensor).

Also, the temperature comparing step (M) may be carried out between the circulating step (A1) and the closing step (A3) included in the heat-exchanging step (S220), so as to determine whether to perform the heat-exchanging step (S220) again or the cooling step (S240).

As broadly described and embodied herein, an aspect of the detailed description is to provide a clothes treating apparatus having a fan circulating internal air and external air of a circulation passage. Another aspect of the detailed description is to provide a clothes treating apparatus capable of cooling a compressor using the fan.

To achieve these and other advantages and in accordance with the purpose of this specification, as embodied and broadly described herein, there is provided a clothes treating apparatus which may include a cabinet defining appearance of the apparatus and having an introduction opening, a clothes receiving device provided in the cabinet and receiving therein clothes through the introduction opening, a circulation passage through which internal air of the clothes receiving device circulates, and a fan configured to supply external air of the circulation passage into the circulation passage.

Also, the apparatus may further include a heat-exchanging passage through which the fan and the circulation passage are connected to each other. The heat-exchanging passage may include a first heat-exchanging duct having one end open toward an outside of the circulation passage and another end connected to the circulation passage, such that the external air of the circulation passage is introduced therethrough, and a second heat-exchanging duct having one end connected to the circulation passage and another end connected to the fan, such that the internal air of the circulation passage is discharged therethrough.

The apparatus may further include a heat-exchanging device provided in the circulation passage, and a compressor connected to the heat-exchanging device to compress a refrigerant. Here, the fan may supply air into the compressor to cool the compressor. The first heat-exchanging duct and the second heat-exchanging duct may be connected to the heat-exchanging device.

The heat-exchanging device may include a first heat-exchanger configured to dehumidify the internal air of the circulation passage, and a second heat-exchanger configured to heat the internal air of the circulation passage. The first heat-exchanging duct and the second heat-exchanging duct may be connected to the first heat-exchanger.

The apparatus may further comprise an inner air hole penetrating through the first heat-exchanging duct and the second heat-exchanging duct. The apparatus may further include an opening/closing unit provided at the heat-exchanging passage to open and close the heat-exchanging passage.

The opening/closing unit may include an opening/closing member configured to open and close the first heat-exchanging duct and the second heat-exchanging duct, and an opening/closing valve configured to control opening/closing of the opening/closing member.

The opening/closing member may open and close the first heat-exchanging duct and the second heat-exchanging duct in a simultaneous manner. The opening/closing member may be provided at the inner air hole.

Here, the first heat-exchanging duct and the second heat-exchanging duct may communicate with each other through the inner air hole so as to allow for air circulation when the first heat-exchanging duct and the second heat-exchanging duct are closed by the opening/closing member.

Also, the inner air hole may be closed by the opening/closing member when the first heat-exchanging duct and the second heat-exchanging duct are open by the opening/closing member.

The external air of the circulation passage may circulate sequentially along the first heat-exchanging duct, the second heat-exchanging duct and the fan, and then is discharged out of the circulation passage, when the first heat-exchanging duct and the second heat-exchanging duct are open by the opening/closing member.

In one embodiment, a method for controlling a clothes treating apparatus may include a cabinet defining appearance of the apparatus and having an introduction opening, a clothes receiving unit provided in the cabinet to receive therein clothes through the introduction opening, a circulation passage through which internal air of the clothes receiving unit circulates, a fan to supply external air of the circulation passage into the circulation passage, and a heat-exchanging passage through which the fan and the circulation passage are connected to each other, the method including a drying step of drying the clothes, wherein the drying step includes a heat-exchanging step of performing heat exchange between the external air of the circulation passage and internal air of the circulation passage by operating the fan.

The control method may further include a washing step of washing the clothes received in the clothes receiving unit before the drying step. The washing step may include a heat-exchanging step of performing heat exchange the external air and the internal air of the circulation passage by driving the fan.

The heat-exchanging passage may include a first heat-exchanging duct having one end open toward an outside of the circulation passage and another end connected to the circulation passage, such that the external air of the circulation passage is introduced therethrough, and a second heat-exchanging duct having one end connected to the circulation passage and another end connected to the fan, such that the internal air of the circulation passage is discharged therethrough.

In the method of controlling the clothes treating apparatus further including a heat-exchanging unit provided in the circulation passage, and a compressor connected to the heat-exchanging unit to compress a refrigerant, the control method may further include a cooling step of supplying air into a compressor to cool the compressor heated by the fan.

Also, in the method of controlling the clothes treating apparatus further including an opening/closing unit provided at the heat-exchanging passage to simultaneously open and close the first heat-exchanging duct and the second heat-exchanging duct, the heat-exchanging step may include an opening step of opening the first heat-exchanging duct and the second heat-exchanging duct by operating the opening/closing unit, a circulating step of introducing external air through the first heat-exchanging duct and discharging internal air through the second heat-exchanging duct by operating the fan, and a closing step of closing the first heat-exchanging duct and the second heat-exchanging duct by operating the opening/closing unit after the circulating step.

Meanwhile, in the method of controlling the clothes treating apparatus further comprising an opening/closing unit provided at the heat-exchanging passage to simultaneously open and close the first heat-exchanging duct and the second heat-exchanging duct, the cooling step may include an opening/closing checking step of checking whether the first heat-exchanging duct and the second heat-exchanging duct have been opened or closed, so as to go to the next step when closed, and go to the next step after closing the first heat-exchanging duct and the second heat-exchanging duct by operating the opening/closing unit when opened, and a supplying step of supplying air into the compressor by operating the fan to cool the compressor.

The control method may further include a temperature comparing step prior to the heat-exchanging step. The temperature comparing step may include measuring an internal temperature (T1) of the circulation passage, measuring an external temperature (T2) of the circulation passage, comparing the internal temperature (T1) and the external temperature (T2), and performing the cooling step when the internal temperature (T1) is higher than the external temperature (T2) and performing the heat-exchanging step when the internal temperature (T1) is lower than the external temperature (T2).

The present disclosure can provide a clothes treating apparatus, capable of increasing temperature of internal air of a circulation passage by circulating external air and internal air of the circulation passage by use of a fan.

Also, the present disclosure can provide a clothes treating apparatus, capable of lowering humidity of internal air of a circulation passage by circulating external air and internal air of the circulation passage by use of the fan.

The present disclosure can provide a clothes treating apparatus, capable of cooling a heated compressor using the fan.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treating apparatus comprising:

a cabinet defining an outer appearance of the apparatus and having an introduction opening;

a clothes receiving device provided in the cabinet and configured to receive clothes through the introduction opening;

a circulation passage configured to circulate internal air of the clothes receiving device;

a heat-exchanging passage connected to the circulation passage to guide external air outside the circulation passage into the circulation passage for heat exchange with the internal air of the circulation passage; and a fan provided at the heat-exchanging passage to generate airflow in the heat-exchanging passage, wherein the heat-exchanging passage includes:

a first heat-exchanging duct having one end open toward an outside of the circulation passage and another end connected to the circulation passage; and a second heat-exchanging duct having one end connected to the circulation passage and another end in communication with the fan.

2. The apparatus of claim 1, further comprising:

a heat-exchanging device provided in the circulation passage; and a compressor connected to the heat-exchanging device to compress a refrigerant, wherein the fan generates airflow toward the compressor to cool the compressor.

3. The apparatus of claim 2, wherein the first heat-exchanging duct and the second heat-exchanging duct are coupled to the heat-exchanging device.

4. The apparatus of claim 3, wherein the heat-exchanging device includes a first heat-exchanger configured to dehumidify the internal air of the circulation passage, and a second heat-exchanger configured to heat the internal air of the circulation passage, wherein the first heat-exchanging duct and the second heat-exchanging duct are coupled to the first heat-exchanger.

5. The apparatus of claim 1, wherein the first heat-exchanging duct and the second heat-exchanging duct are adjacent to each other and an inner air hole is provided between the first heat-exchanging duct and the second heat-exchanging duct.

6. The apparatus of claim 5, further comprising a valve unit provided at the heat-exchanging passage to open and close the heat-exchanging passage.

7. The apparatus of claim 6, wherein the valve unit includes a valve configured to open and close the first heat-exchanging duct and the second heat-exchanging duct, and a valve controller configured to control the valve to open and close.

8. The apparatus of claim 7, wherein the valve opens and closes the first heat-exchanging duct and the second heat-exchanging duct in a simultaneous manner.

9. The apparatus of claim 8, wherein the valve is provided at the inner air hole.

10. The apparatus of claim 9, wherein the first heat-exchanging duct and the second heat-exchanging duct communicate with each other through the inner air hole so as to allow for air circulation when the first heat-exchanging duct and the second heat-exchanging duct are closed by the valve.

11. The apparatus of claim 9, wherein the inner air hole is closed by the valve when the first heat-exchanging duct and the second heat-exchanging duct are open.

12. The apparatus of claim 11, wherein, when the valve is in an open state to open the first heat-exchanging duct and the second heat-exchanging duct, external air of the circulation passage circulates sequentially along the first heat-exchanging duct, the second heat-exchanging duct and the fan, and then is discharged out of the heat-exchanging passage.

13. A method for controlling a clothes treating apparatus comprising a cabinet defining an outer appearance of the apparatus and having an introduction opening, a clothes receiving device provided in the cabinet and configured to receive clothes through the introduction opening, a circulation passage configured to circulate internal air of the clothes receiving device, a heat-exchanging passage connected to the circulation passage to guide external air outside the circulation passage into the circulation passage for heat exchange with the internal air of the circulation passage, and a fan provided at the heat-exchanging passage to generate airflow in the heat-exchanging passage, the method comprising:

a drying step of drying the clothes, wherein the drying step includes a heat-exchanging step of performing heat exchange between the external air from outside the circulation passage and internal air of the circulation passage by operating the fan, wherein the heat-exchanging passage includes:

a first heat-exchanging duct having one end open toward an outside of the circulation passage and another end connected to the circulation passage; and a second heat-exchanging duct having one end connected to the circulation passage and another end in communication with the fan.

14. The method of claim 13, further comprising:

a washing step of washing the clothes received in the clothes receiving device before the drying step, wherein the washing step includes a heat-exchanging step of performing heat exchange between the external air and the internal air of the circulation passage by driving the fan.

15. The method of claim 13, wherein a heat-exchanging device is provided in the circulation passage and a compressor is connected to the heat-exchanging device to compress a refrigerant, and wherein the control method further comprises a cooling step of controlling the fan to generate airflow toward the compressor to cool the compressor.

16. The method of one of claim 13, wherein a valve unit is provided at the heat-exchanging passage to simultaneously open and close the first heat-exchanging duct and the second heat-exchanging duct, and wherein the heat-exchanging step includes an opening step of opening the first heat-exchanging duct and the second heat-exchanging duct by operating the valve unit, a circulating step of introducing external air through the first heat-exchanging duct and discharging internal air through the second heat-exchanging duct by operating the fan, and a closing step of closing the first heat-exchanging duct and the second heat-exchanging duct by operating the valve unit after the circulating step.

17. The method of claim 15, wherein the cooling step includes an opening/closing checking step of checking whether the first heat-exchanging duct and the second heat-exchanging duct are opened or closed, and closing the first heat-exchanging duct and the second heat-exchanging duct by operating a valve unit, and performing the cooling step to generate airflow to cool the compressor.

18. The method of claim 15, further comprising a temperature comparing step prior to the heat-exchanging step, wherein the temperature comparing step comprises:

measuring an internal temperature (T1) of the circulation passage;

measuring an external temperature (T2) outside the circulation passage and inside the cabinet;

comparing the internal temperature (T1) and the external temperature (T2); and performing the cooling step when the internal temperature (T1) is higher than the external temperature (T2) and performing the heat-exchanging step when the internal temperature (T1) is lower than the external temperature (T2).

* * * * *